US005613379A

United States Patent [19]

Kim

[11] Patent Number: 5,613,379

[45] Date of Patent: Mar. 25, 1997

[54] DETERGENT DISSOLVING APPARATUS FOR A CLOTHES WASHER

[75] Inventor: Jin D. Kim, Ansan, Rep. of Korea

[73] Assignee: Samsung Electronics Co., Ltd., Suwon, Rep. of Korea

[21] Appl. No.: 551,331

[22] Filed: Nov. 1, 1995

[30] Foreign Application Priority Data

Nov. 1, 1994 [KR] Rep. of Korea ..... UM 94-28975 U
Oct. 26, 1995 [KR] Rep. of Korea ..... 95-37355

[51] Int. Cl.[6] ..... D06F 39/02

[52] U.S. Cl. ..... 68/17 R

[58] Field of Search ..... 68/17 R; 134/93; 137/268; 422/263, 266, 267, 274, 276

[56] References Cited

U.S. PATENT DOCUMENTS 5,473,914 12/1995 Pyo et al. ..... 68/17 R

FOREIGN PATENT DOCUMENTS 3804302 8/1989 Germany ..... 68/17 R

*Primary Examiner*—Philip R. Coe
*Attorney, Agent, or Firm*—Burns, Doane, Swecker & Mathis, L.L.P.

[57] ABSTRACT

In order to dissolve powdered detergent prior to its being introduced into a clothes washer, the detergent is placed in a conical container which is slid into a body to a position beneath a water inlet nozzle. The container carries a filter which is pushed upwardly so that its upper edge bears against a top wall of the body.

8 Claims, 5 Drawing Sheets

DETERGENT DISSOLVING APPARATUS FOR A CLOTHES WASHER

BACKGROUND OF THE INVENTION

This invention relates to a powered detergent dissolving apparatus of a washing machine, and more particularly, to a detergent dissolving container for receiving the laundry detergent.

In general, when laundry is washed by a washing machine, some of the powered detergent employed to wash the laundry frequently remains, unless the rinsing cycle is performed several times or the detergent is dissolved with water in advance outside of the washing machine. Therefore, the solution of the problem may involve a mechanical detergent dissolving apparatus which can prevent the detergent from remaining on clothes.

A conventional mechanical detergent dissolving apparatus which utilizes the stream force of water jetted through a water supply jetting pipe is illustrated in FIG. 1. The mechanical detergent dissolving apparatus comprises an outer body 1 in the form of a cube box and an inner body 2A slided leftward and rightward into or from the outer body 1. The inner body 2A includes a filter 3 placed therein with the detergent. The outer body 1 is provided with a water supply opening 4 formed on its top surface to introduce wash water thereinto. The water supply opening 4 is coupled with a water supply tube 6, and a water guide tube 7 is mounted between the water supply opening 4 and the water supply tube 6, in which the water guide tube 7 includes a water jetting nozzle 5 which is narrowed in a tapered form toward the lower portion from the upper portion to accelerate the water supply into the wash tube. An air intaking hole 9 is formed between the water jetting nozzle 5 and the water guide tube 7 for increasing the efficiency of the detergent dissolution. An auxiliary filter 8 of a net type is arranged between the water guide tube 7 and the water supply tube 4 to prevent the reverse flowing of water supplied.

The detergent dissolving apparatus is assembled so that the water supply tube 7 is coupled into the water supply opening 4 together with the jetting nozzle 5, and the filter 3 in the form of a funnel or a truncated cone is placed in the inner body 2A which is and then inserted into the outer body 1.

The reduced cross-sectional outlet of the jetting nozzle 5, and the presence of air intaking hole 9 serve to increase the stream speed of water supplied, thereby forming a faster stream. The stream strikes against the detergent received in the filter 3 and forms a vortex in the inner body 2A after passing through the filter 3, thereby dissolving the detergent.

The detergent dissolving apparatus must be operated so that the wash water jetted from the jetting nozzle 5 is passed through the received detergent and the bottom net surface of the filter 3 by its own energy. A mass A of detergent particles is separated by force of stream $F_1$, and the detergent is dissolved during the circulation of the detergent particles in the filter 3. But, when the stream pressure is in the lower weaker state of about 0.8 Kgf/cm$_2$), the force acting against the mass A is too weak to dislodge the mass. Thus, the mass of the detergent still remains at the upper edge of the filter 3.

Moreover, at the initial stage of the water supply, the detergent particles overflow from the upper periphery of the filter, within a water stream "$F_2$" and will accumulate in the lower corner portion C. Consequently, the water stream $F_2$ can not contact the accumulated detergent, so it remains.

Furthermore, since the detergent particles are undissolved at the initial stage of the main water supply when the stream has high pressure, these particles fully occupy the filter, and thereby reduce the outgoing water volume to a value less than that of the incoming water passing through the jetting nozzle. Also, a lump of detergent particles entrained in the water is reverse-flowed out by the force of a stream F from the top of the detergent container 3. In order to solve the problem, the gap G, through which a detergent flows out, needs to be narrower. However the more the gap is narrowed, the more the detergent dissolved in the water flows out backward through the air intaking hole 9 of the water guide tube 7. This phenomenon is prevented by using a check valve, but it is very difficult to prevent the reverse-flowing of wash water toward a warming water connecting tube during the supplying of cool water. This phenomenon also continues for an extended period, because the reduced-pressure water stream can not quickly dissolve the detergent. The problem becomes more serious as the detergent substance in the filter becomes more sticky. To solve this problem, the filter 3 is installed at the outlet of the water supply valve, but this too becomes a factor in reducing the nozzle jetting force.

The conventional detergent dissolving apparatus thus has problems of the remaining avoiding the detergent, the discharging of a larger amount of undissolved detergent particles, the limitations in improving the performance and the quality due to the conflicting solutions relating the reverse-flowing relationship as well as the delay of the washing time due to the reduction of the cross-sectional area of a jetting pipe or nozzle. Therefore, it is very desirous to solve the problems by a simple structure.

An object of the invention is to provide a detergent dissolving apparatus including a detergent container to improve a filter portion, thereby preventing undissolved detergent from flowing out of the detergent container.

Another object of the invention is to provide the detergent dissolving apparatus for increasing the vortex stream force of washing water in the detergent container and dissolving an amount of powdered detergent, quickly.

Another object of the invention is to provide the detergent dissolving apparatus having a compact structure in which a supporter supports the detergent container with its height portion being extended from an inner body.

SUMMARY OF THE INVENTION

According to the invention, a detergent dissolving apparatus comprises an outer body including a water supply opening, a water supply connecting tube connected to a water supply valve pipe, a water guide tube for guiding water from the water supply connecting tube into the detergent dissolving apparatus, a jetting nozzle mounted in the water guide tube, its cross-sectional area being reduced to increase the flowing speed of wash water, a filter plate mounted in the water supply opening to prevent the reverse-flowing of wash water supplied; and an inner body slidable into the outer body and including a detergent container closely contacted at its upper edge to the upper surface of the outer body, the detergent container being provided with a filter portion formed starting from around the middle height to around the ¼ height thereof, in which the inner body is provided with side walls set to be higher than a maximum height of the filter portion.

On the other hand, a supporter includes an adjusting nut for adjusting its height, which nut is attached to a supporter passing through the bottom surfaces of the inner and outer bodies to support the detergent dissolving container. In that case, the inner body has a longitudinal hole formed on its bottom surface to be inserted into the outer body.

An alternative supporter includes a head and a height portion or a supporting portion, in which the head is threadedly inserted into the bottom of the inner body to move upward and support the detergent container.

Another supporter includes a head, a stem portion having a predetermined height and a supporting portion, in which the head is faced toward the bottom surface of the outer body, the stem portion is extended into the bottom surface of the inner body, and the supporting portion is moved upward by the predetermined height and supports the detergent container, when the inner body is inserted into the outer body.

Therefore, the detergent dissolving apparatus is assembled in a washing machine after the inner body is inserted into the outer body with the detergent container loaded with an amount of powder detergent. The detergent dissolving apparatus enables the detergent and wash water to avoid being over-flowed out of the upper portion of the detergent container, thereby discharging the detergent dissolved water through the filter portion.

BRIEF DESCRIPTION OF THE DRAWINGS

The invention now will be described in detail with reference to the accompanying drawings, in which.

DETAILED DESCRIPTION OF PREFERRED EMBODIMENTS OF THE INVENTION

Figure 3:
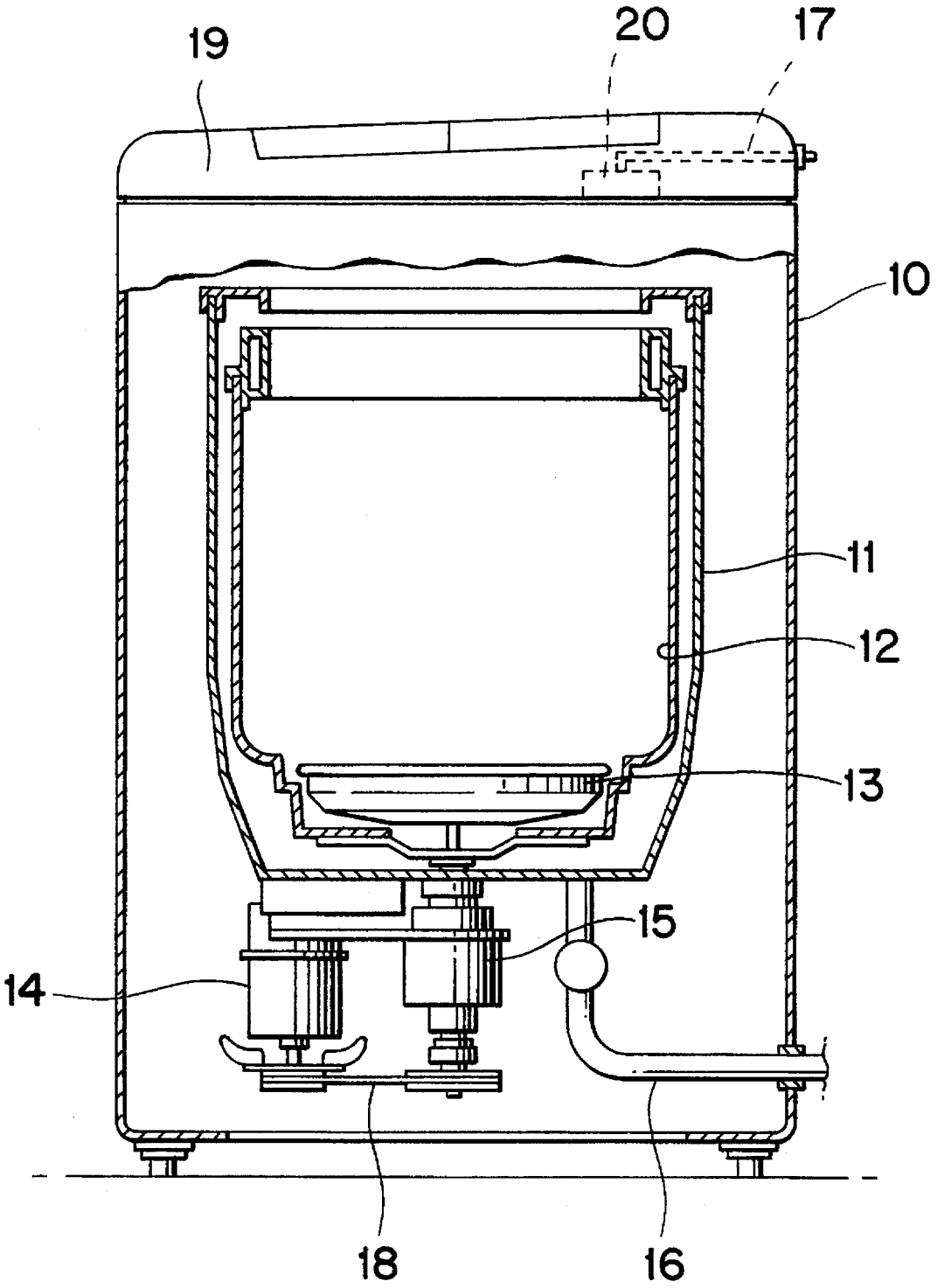
FIG. 3 is a side elevational view, partly broken away illustrating the coupling of a water supply valve pipe with a detergent dissolving apparatus which is properly mounted in a washing machine according to the principle of the invention; and, FIG. 4 is a vertical sectional view illustrating the configuration of the detergent dissolving apparatus including a detergent container which is supported in an inner body according to one embodiment of the invention.
Figure 5:
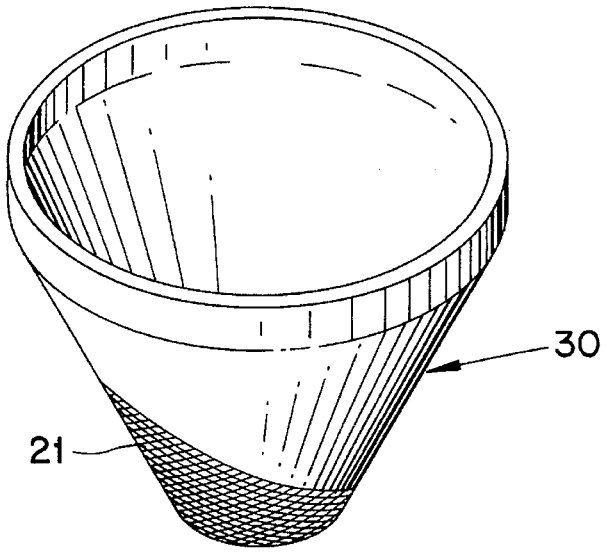
FIG. 5 is a perspective view illustrating a detergent container according to the invention.

According to the invention, a detergent dissolving apparatus 20 is mounted on the upper portion of a washing machine 10 as shown in FIG. 3. The washing machine includes a body 10, which is considered a full automatic washing machine. A water tank 11 is installed in the body 10, and a water discharging hose 16 is coupled adjacent to the lower portion of the tank 11 and extended in a predetermined length out of the body 10. A washing tub 12 is mounted in the water tank 11 to be spaced away from the wall portion of the water tank 11, in which a pulsator 13 is rotatably installed. The pulsator 13 is fixed at its center portion to the shaft of a power transferring mechanism 15. A motor 14 is connected to the power transferring portion 15, so that power is transferred to the power transferring portion 15 by means of a pulley 18 coupled to the shaft thereof.

The detergent dissolving apparatus 20 is placed directly below a cover portion 19, which is connected to a water supply valve pipe 17 coupled to a valve at the rear portion of the washing machine. Thus, the detergent dissolving apparatus 20 enables the detergent containing wash water to be dropped into the water tank 11.

Figure 1:
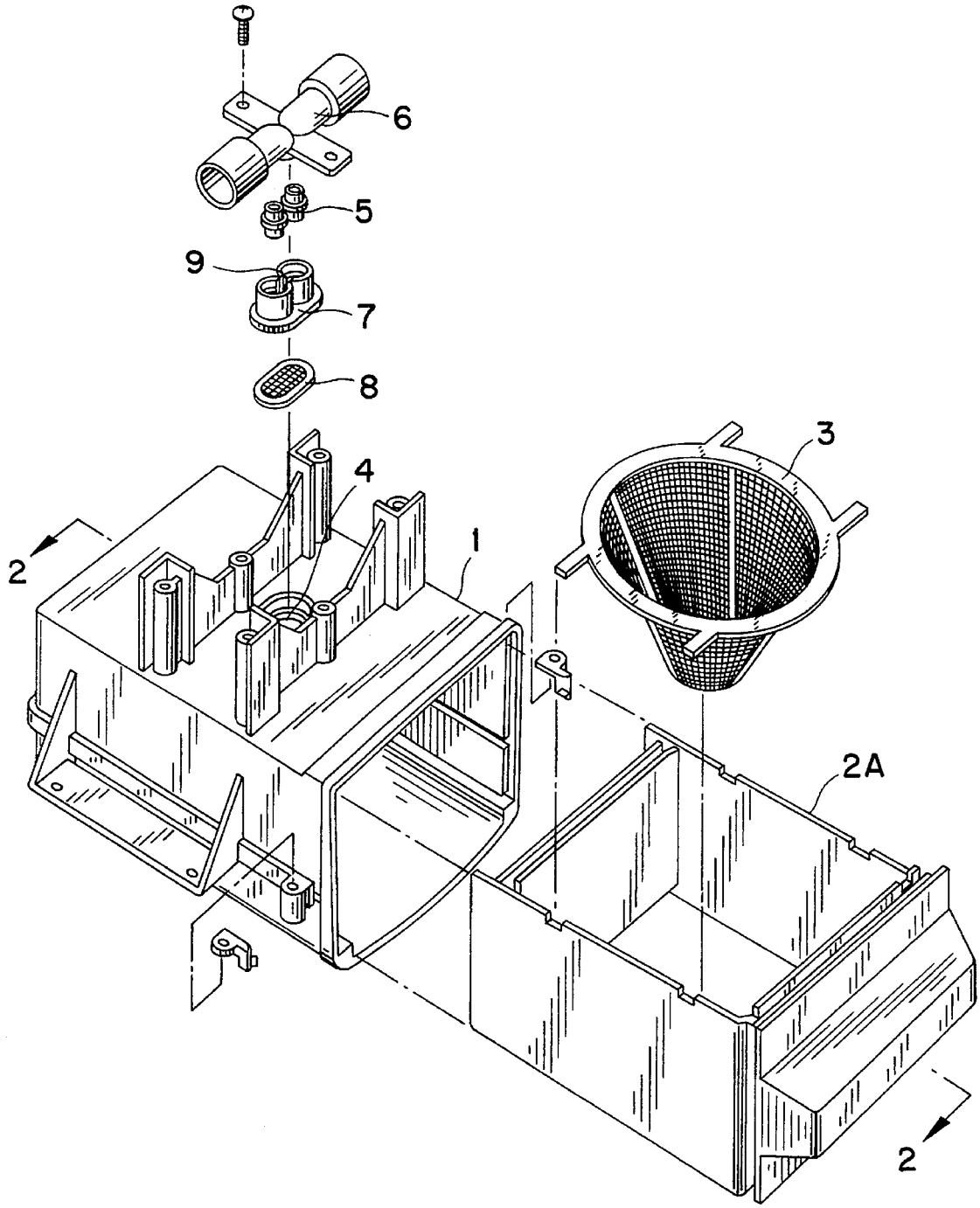
FIG. 1 (PRIOR ART)
FIG. 1 is an exploded perspective view illustrating a conventional detergent dissolving apparatus.
Figure 2:
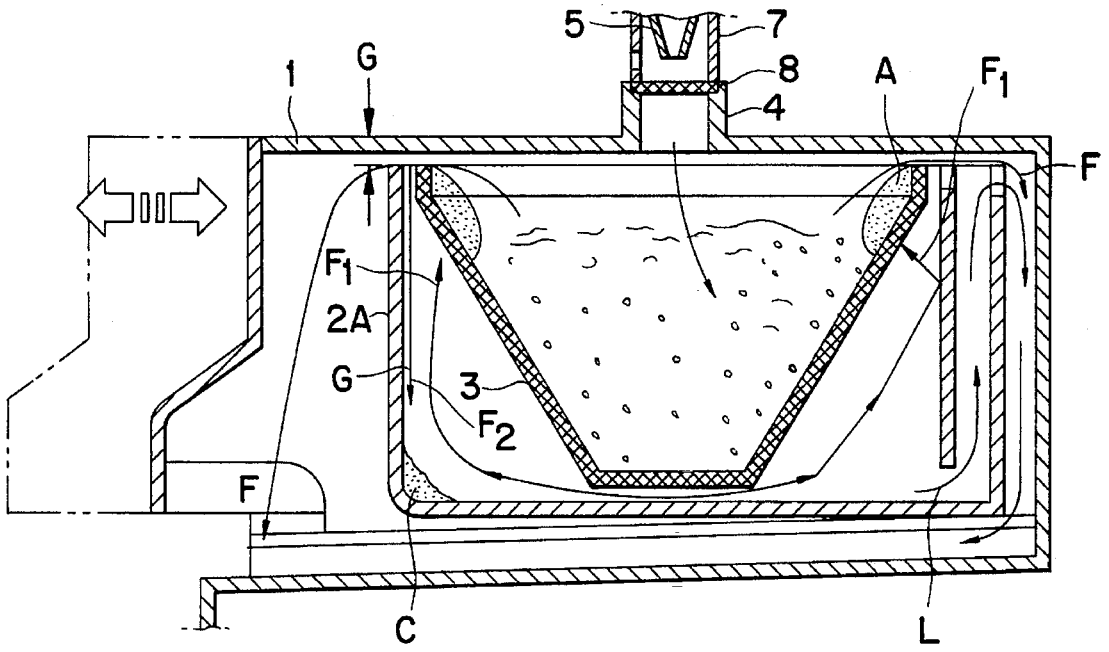
FIG. 2 (PRIOR ART)
FIG. 2 is a vertical cross-sectional view taken along the line 2—2 of FIG. 1.

The detergent dissolving apparatus 20 will be explained with the same elements as those of FIG. 2 being referenced by the same numbers.

Figure 4:
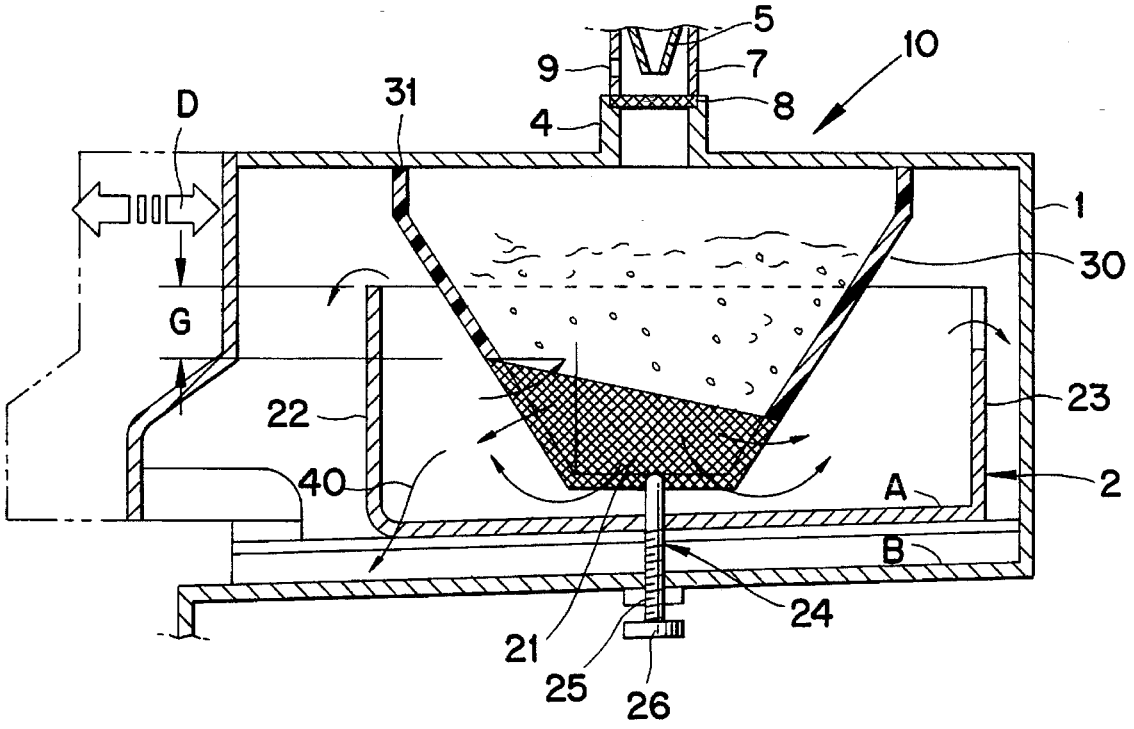

Referring to FIG. 4, the detergent dissolving apparatus 20 comprises an outer body 1 and an inner body 2 like the prior art. The outer body 1 includes a water supply opening 4 formed on the upper surface thereof, a water guide tube 7 having an air intaking hole 9, a jetting nozzle 5 mounted in the water guide tube 7 to increase the stream speed of wash water supplied from, its cross-sectional area being reduced to increase the flowing speed of wash water from the water supply connecting tube 17 filter plate 8 is mounted in the water supply opening 4 to prevent the reverse-flowing of wash water supplied. The inner body 2 is slidable in direction D into the outer body 1. At that time, the bottom surface A of the upper body is spaced above the bottom surface B of the outer body 1 to facilitate the assembly of the inner body 2 into the outer body 1.

The inner body 2 has a detergent container 30 positioned therein. The detergent container 30 in the form of a funnel or a truncated cone includes a filter portion 21 formed starting from around the middle height to around the ¼ height thereof. The detergent container 30 made of a material the same as that of the inner or outer bodies or a synthetic resin is constructed to be integrated with the filter portion 21. The center portion of the filer portion 21 constitutes a supporting portion of a predetermined area contacted by a supporter 24.

On the other hand, the detergent container 30 has a size set to dissolve an amount of powder detergent by 88–89% at the capacity of a wash tub available for a predetermined weight of laundry clothes, for example 9 Kg, within the range from low water pressure of 0.8 $Kgf/cm^2$ to the high water pressure of 2 $Kgf/cm^2$. Herein, it is noted that wash water jetted from the jetting nozzle 5 should be not flowed back through the filter plate 8 to the water supply connecting tube 17, and the volume of the detergent container 30 should be smaller than that of the inner body 2.

The inner body 2 is constructed to supply the detergent dissolved wash water into the wash tube 12 fast. To this end, the inner body 2 includes one side wall 22 having a predetermined height greater than the maximum height of the filter portion 21, by an amount or gap G thereby causing the vortex stream of wash water to dissolve the detergent between the inner body 2 and the detergent container 30. Also, the inner body 2 is provided with another side wall 23 having a height equal to the maximum height of the filter portion 21.

The detergent container 30 is closed at its upper edge 31 against the outer body 1, when it is positioned in the inner body 2 and then inserted into the outer body 1. In other words, the detergent container 30 is supported vertically by means of the supporter 24 with its center portion being in line with that of the water supply opening 4. The upper edge 31 of the detergent container 30 engages the upper surface of the outer body 1 to prevent over-flowing of water wash and undissolved detergent out of the detergent container 30.

The supporter 24 includes a nut 25 pad a head 26 for adjusting its height. In order to support the detergent dissolving container 30, the supporter 24 is passed through the bottom surfaces of the outer and inner bodies 1 and 2. In that case, the inner body 2 has a longitudinal hole(not shown) formed on its bottom surface from the rear to over the center portion of its bottom surface at the middle portion of the side wall to be smoothly inserted into the outer body 1.

Therefore, as shown in FIG. 4, the inner body 2 with the detergent container 30 being positioned therein is slidable into the outer body 1 is direction D. The supporter 24 is projected upward by rotating the supporter 24 adjusting until the nut 25 presses the detergent container 30 against the upper portion of the outer body 1. Then, the assembly of the detergent dissolving apparatus 20 is completed by being connected to the water supply connecting tube 17.

Figure 6:
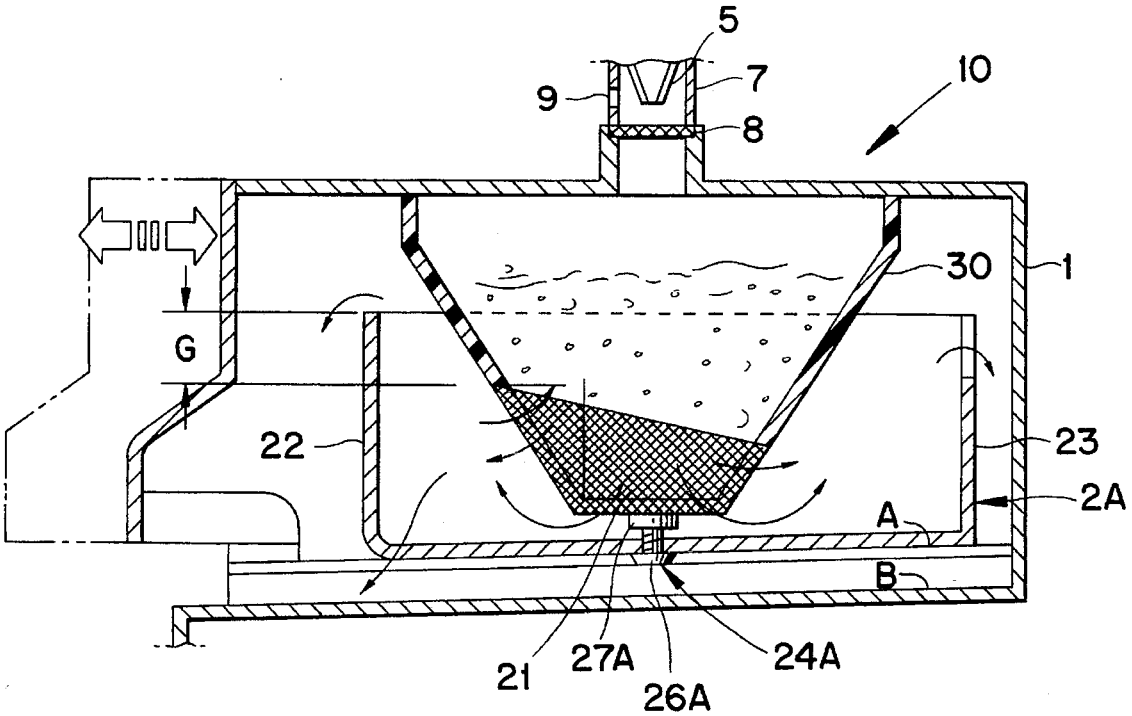
FIG. 6 is a view similar to FIG. 4 of a second embodiment of the invention.

As shown in FIG. 6, another supporter 24A includes a head 26A a stem portion 28B and supporting nut 27A. The head stem 28A is threadedly inserted into the bottom of the inner body 2A to move upward and support the detergent container 20.

Figure 7:
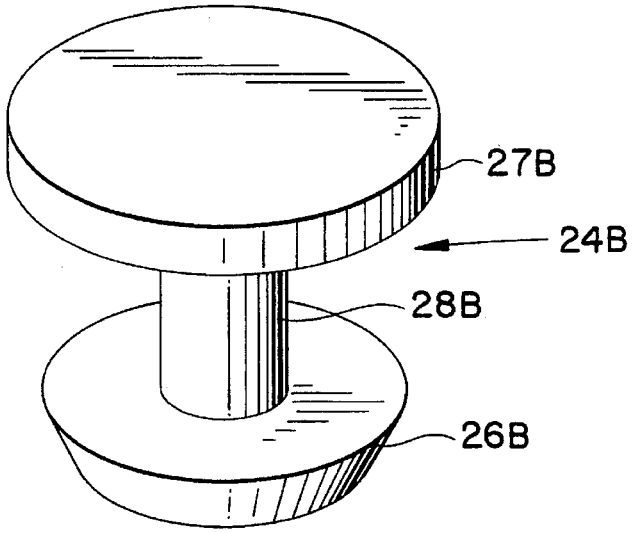
FIG. 7 is a perspective view illustrating another embodiment of a supporter according to the invention.

As shown in FIG. 7, another supporter 24B includes a head 26B a stem portion 28B having a predetermined height to move the detergent container 30 upward and a supporting portion 27B. The supporter 24B inserted into the center portion of the bottom surface A, and then the supporting portion 27B is fixed to the top of the stem portion 28B.

Figure 8:
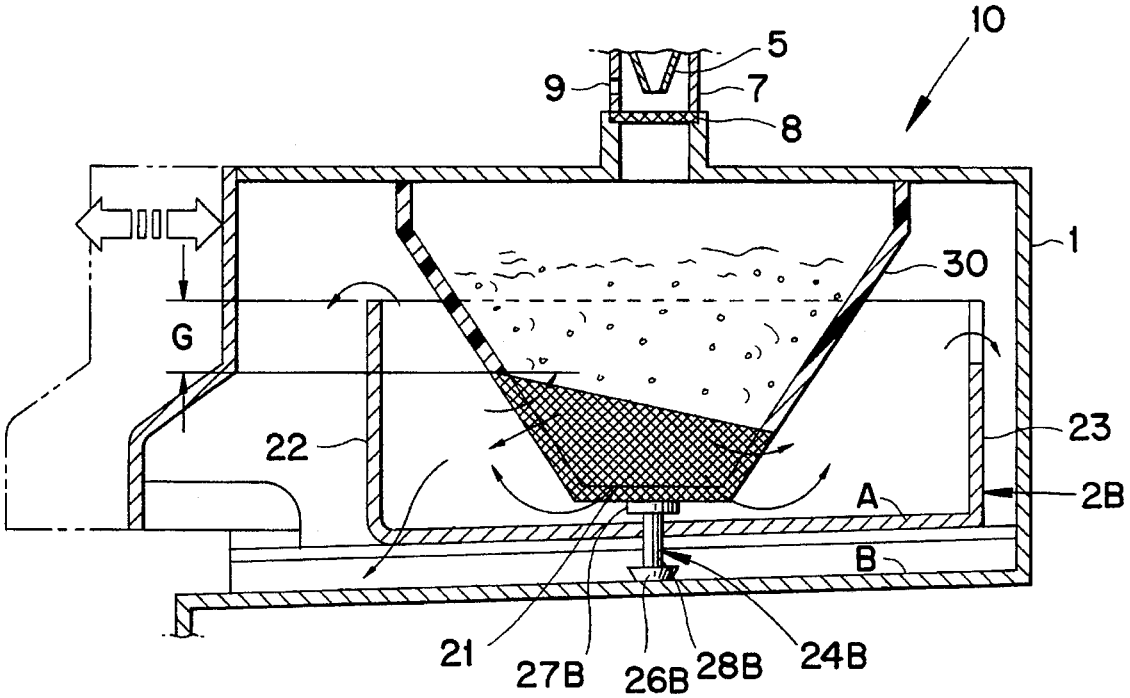
FIG. 8 is a view similar to FIG. 4.

As shown in FIG. 8, when the inner body 2B is inserted into the outer body 1, the head 26B is faced toward the bottom surface of the outer body 1, while the stem portion 28B is projected into the bottom surface of the inner body 2B. The supporting portion 27B is moved upward by the predetermined height and supports the detergent container 30.

Therefore, after the detergent container 30 is loaded with an amount of powder detergent the inner body is inserted into the outer body 1. Wash water is jetted from the jetting nozzle 5 and through the water supply opening 4 into the detergent container. The closed space of the detergent container 30 increases the stream speed of wash water supplied to generate the more vortex current. If the detergent container 30 has the proper amount of the detergent and the volume suitable thereto, it enables the detergent and wash water to avoid being over-flowed out of the upper portion of the detergent container 30, thereby discharging the detergent dissolved water through the filter portion 21, after which it flows over the side walls 22, 23 and also in a direction of arrow 40 through holes formed in the bottom of the inner body 2.

What is claimed is:

1. A detergent dissolving apparatus adapted to be mounted in a clothes washer for dissolving powdered detergent, the apparatus comprising:

an outer body adapted to be fixed on a clothes washer;

a water guide tube for conducting water;

a jetting nozzle at an end of the water guide tube for ejecting the water downwardly through a top wall of the outer body and into an interior of the outer body;

a first filter mounted in the water guide tube for preventing a backflow of water;

an inner body slidable into and from the outer body, the inner body including upstanding side walls;

a detergent container disposed in the inner body to be located beneath the nozzle when the inner body is slid into the outer body, the detergent container including a second filter extending upwardly to a height no higher than about a vertical midpoint of the detergent container and lower than upper edges of the side walls; and a supporter for pushing the detergent container upwardly such that an upper edge of the detergent container bears against the top wall of the outer body.

2. The apparatus according to claim 1 wherein each of the inner and outer bodies includes a bottom wall, the supporter extending through at least one of the bottom walls.

3. The apparatus according to claim 2 wherein the supporter extends through both bottom walls.

4. The apparatus according to claim 2 wherein the supporter only passes through the bottom wall of the inner body.

5. The apparatus according to claim 4 wherein the supporter includes a stem passing through the bottom wall of the inner body, a head disposed beneath such bottom wall, and a supporting portion disposed above such bottom wall and engaging the bottom of the second filter.

6. The apparatus according to claim 1 wherein the second filter extends upwardly past one-quarter of a height of the detergent container.

7. The apparatus according to claim 1 wherein the supporter is vertically adjustable.

8. The apparatus according to claim 1 wherein the container is of conical shape.

* * * * *